United States Patent [19]

Robertson

[11] 4,130,906

[45] Dec. 26, 1978

[54] WATER CLOSET LID COVER

[76] Inventor: Carl L. Robertson, 3104 Carlton Way, Oklahoma City, Okla. 73120

[21] Appl. No.: 811,555

[22] Filed: Jun. 30, 1977

[51] Int. Cl.[2] ..... A47K 13/14

[52] U.S. Cl. ..... 4/242

[58] Field of Search ..... 4/234, 242, 237, 235, 4/236, 241; 16/189

[56] References Cited

U.S. PATENT DOCUMENTS

| | | | |
|---|---|---|---|
| 2,608,694 | 9/1952 | McCamy | 4/242 |
| 2,858,549 | 11/1958 | Carson | 4/242 |
| 2,903,713 | 9/1959 | Previte | 4/242 |
| 2,910,705 | 11/1959 | Coplan | 4/242 |
| 2,994,887 | 8/1961 | Thornton | 4/242 |
| 3,102,276 | 9/1963 | Warnberg | 4/242 |
| 3,118,149 | 1/1964 | Tomasetti | 4/242 |
| 3,653,076 | 4/1972 | Warnberg | 4/242 |

*Primary Examiner*—Henry K. Artis
*Attorney, Agent, or Firm*—William R. Laney

[57] ABSTRACT

A flexible fabric cover for a water closet lid which includes an upper panel and a lower panel of substantially the same shape as the upper panel and stitched at a location adjacent the periphery thereof to a major portion of the periphery of the upper panel to retain the panels in a registering and superimposed position with respect to each other. An opening of lesser width than the maximum width of each of the panels at the center thereof separates the peripheries of the panels at one side thereof, and a pair of spaced elastomeric bands extend from opposite sides of the opening along the peripheries of the superimposed panels to join the panels to each other over portions of their peripheries adjacent the opening, thereby facilitating resilient enlargement of the opening during mounting of the cover on a water closet lid.

6 Claims, 4 Drawing Figures

WATER CLOSET LID COVER

BACKGROUND OF THE INVENTION

Field of the Invention

This invention relates to fabric covers for pivoted lids used in water closet construction, and more particularly, to covers of the type which cover the water closet lid on both sides with fabric panels, and are removable from the lid for laundering and other purposes.

Brief Description of the Prior Art

A number of types and covers have been heretofore proposed for the purpose of improving the aesthetics of water closet lids, or improving sanitation, or both. Covers for water closet lids have been of various types, but have generally included at least one panel made of various materials ranging from paper to cloth, and extending across and over the upper surface of the lid at the time that the lid is closed. Many of these types of lid cover have not included a second or bottom panel which covers the exposed under side of the lid at such time as the lid may be elevated by pivoting it to its upstanding or upraised position.

In some of the more recent types of water closet lid cover, a double panel lid cover structure has been provided which aesthetically covers both the upper and lower surfaces of the lid with some type of fabric panel, and thus provides an attractive appearance to the lid, whether it is raised or lowered. In some of these structures, a zipper is provided around the periphery of the cover at the location where the side edges of the upper and lower panels of the cover are joined to each other, so that a sufficiently large opening can be provided between the upper and lower panels to permit the cover to be quickly and easily placed in position on the water closet lid. A problem with the zipper construction is that it considerably increases the cost of the lid cover and, more importantly, presents a rusting problem at times when the lid is laundered. Moreover, zippers are, of course, subject to malfunction and, in general, afford no flexibility in the size of the interior space defined within the double paneled covers after the zipper is closed. Such covers are therefore incapable of accommodating lids of differing sizes and shapes.

Other types of water closet lid covers heretofore proposed have employed double panel covers which have a relatively large opening at one end thereof to permit the water closet lid to be inserted between the panels of the cover. The periphery of the opening is then provided with a drawstring which can be pulled taut to close the opening once the cover is placed on the lid. The opening as thus provided is located adjacent the hinge structure at the rear edge of the lid. Frequently, the drawstring type of closure of this opening results in bunching and wrinkling of the fabric at this location, and an unsightly appearance is effected which is perceptible both when the lid is raised and the lower panel of the cover is in view, as well as when the lid is closed to expose the upper panel.

A problem encountered in attempting to eliminate the flexible drawstring effect is that a sufficiently large opening must be provided at the hinged side of the lid cover to permit the largest dimension of the water closet lid to pass through this opening when the cover is placed in position on the lid. Due to the near universal construction of water closet lids in an elliptical or nearly circular disk-shaped configuration, the largest transverse dimension of such lids is generally near the center thereof, and therefore the opening provided at the hinged side of the lid covers must be large enough to permit this wide portion of the lid to pass through such opening as the cover is placed in position. After the cover is installed, the opening at the hinge side of the cover is, of course, substantially wider then the actual edge of both lid and cover at the location of the opening, thus necessitating the use of the drawstring or, in some instances, an elastic band, in order to pucker the lid and draw the opening closed about the lid at this location.

The problem of providing a sufficient opening at one side of the cover to permit the lid to be inserted in the cover when mounting the cover has been aggravated by the fact that the lids which are provided in the various water closet structures now manufactured vary in their size and geometric configuration, thus making it difficult to provide a single opening at one side of the lid cover which is suitable for the accommodation of lids of all sizes and shapes. Therefore, it has been necessary to either tolerate a loose and unsightly installed lid cover on certain relatively small water closet lids, or simply to be unable to use a particular fabric cover on relatively large lids which cannot be inserted through the opening in the cover.

General Description of the Present Invention

The present invention provides an aesthetic flexible cover for covering water closet lids in a way which permits the cover to be very attractive and aesthetic when it is installed. The lid cover of the invention includes structure which facilitates its use on water closet lids of varying sizes and shapes with a snug and neat fit on all such variant water closet lid constructions.

Broadly described, the present invention is a cover for a water closet lid which includes a pair of superimposed panels each of which has an arcutate peripheral edge extending around a major portion thereof, and a back or hinge edge which is relatively straight and extends across one side of the respective panel. The arcuate peripheral edges of the superimposed upper and lower panels of the cover are stitched together over a major portion of the arcuate peripheral edges, with the remaining portions of the arcuate peripheral edges of the two panels being joined to each other through elastic bands at opposite sides of the cover. The elastic bands extend from the opposite ends of an opening formed in the cover between the superimposed panels thereof, with this opening being defined by the straight side edges of the two panels. The elastic bands are joined to peripheral edge portions of the superimposed upper and lower panels in such a way that the panels may be moved farther apart from each other be deformation of the resilient bands through which they are joined. Moreover, the bands facilitate enlargement of the cover opening formed between the panels at one side of the cover so that the cover can be placed on water closet lids of varying sizes and shapes.

In a preferred embodiment of the invention, the strips of elastic bands which join portions of the arcuate peripheral edges of the upper and lower panels of the cover are characterized in being elastically deformable in two directions extending substantially normal to each other to facilitate expansion in a plane normal to the superimposed panels and to the water closet lid covered by the cover of the invention, as well as in a direction which extends substantially parallel to the plane of the panels and the lid. It is moreover a preferred construction of the invention to utilize a pile fabric in the construction of the cover of the invention.

An important object of the invention is to provide a fabric cover for water closet lids, which cover, when installed, is taut and free of wrinkles and is aesthetic in appearance, both from the upper side of the lid as well as below the lid.

An additional object of the invention is to provide a fabric cover for a water closet lid, which cover includes aesthetic pile type fabric panels both above and below the lid when installed, and which can be quickly and easily placed on, or removed from, the lid in order to facilitate laundering of the cover.

Yet another object of the invention is to provide a cover for a water closet lid, which cover has critically located elastic bands forming a part thereof so that the cover can be quickly placed on water closet lids of various sizes and shapes and will retract to a taut aesthetic status when the cover is in place.

Yet another object of the invention is to provide a double panel fabric cover for a water closet lid, in which cover the opposed top and bottom panels are joined to each other in such a way that seams and hems are obscured from view and essentially invisible when the cover is placed in operative position on a water closet lid.

Additional objects and advantages of the invention will become apparent from the following detailed description of a preferred embodiment of the invention when such description is read in conjunction with the accompanying drawing which illustrates such preferred embodiment.

General Description of the Drawings

DETAILED DESCRIPTION OF A PREFERRED EMBODIMENT OF THE INVENTION

Figure 1:
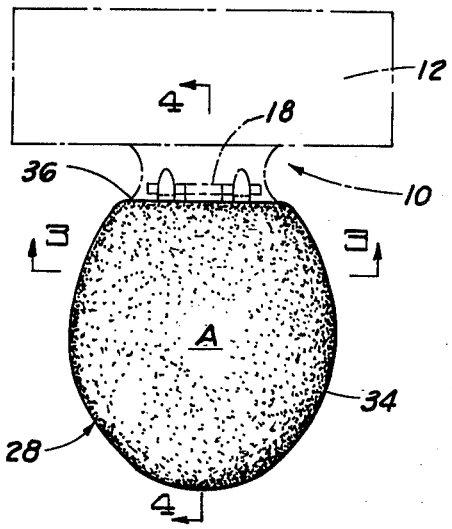
FIG. 1 is a plan view of the water closet lid cover of the invention as it appears when installed upon a water closet lid. Portions of the water closet are illustrated in dashed lines.
Figure 2:
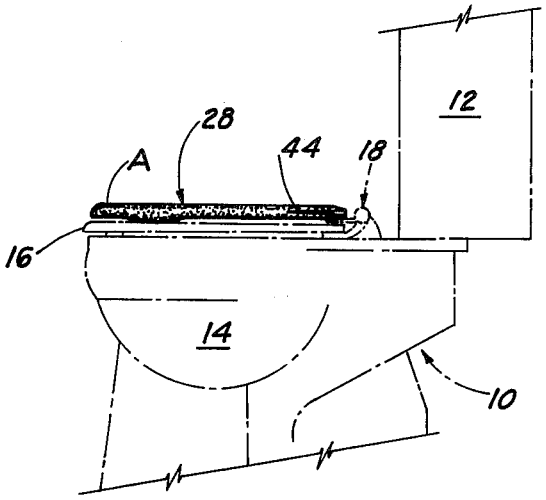
FIG. 2 is a side elevation view of the installed water closet lid cover of the invention and illustrating portions of the water closet in dashed lines.
Figure 4:
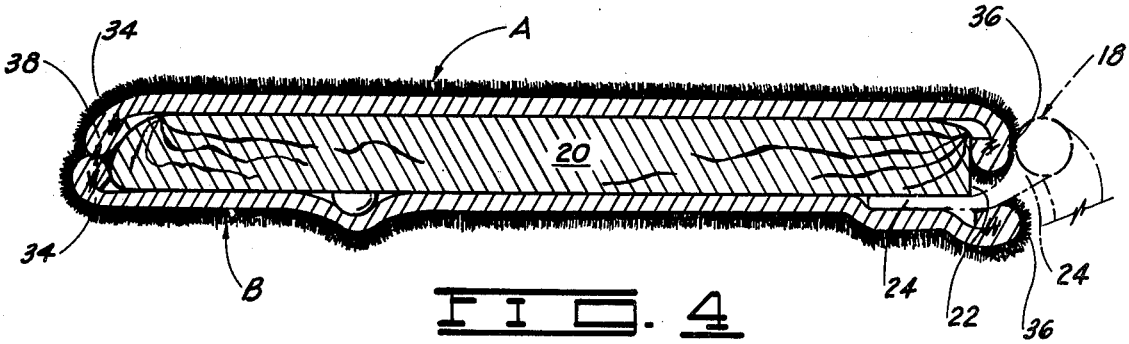
FIG. 4 is a sectional view taken along line 4—4 of FIG. 1.

Referring initially to FIGS. 1 and 2 of the drawings, a water closet structure is there illustrated in dashed lines and is designated generally by reference numeral 10. The water closet structure includes a tank 12, a bowl 14 and a seat 16 which are of conventional construction. Supported at the rear side of the bowl 14 and forward of the lower portion of the tank 12 is a hinge structure 18 by which both the seat 16 and a lid 20 are pivotally mounted on the bowl 14. The lid 20 is generally made of wood or plastic and is secured at its rear edge 22 to a pair of spaced hinge arms 24 for pivotation about a horizontal axis. The lid 20, as here illustrated, is of the usual oval, disk-shaped configuration and as such includes an arcuate outer peripheral side or edge in addition to the back edge 22 (see FIG. 4).

The flexible lid cover of the present invention is shown mounted upon the lid 20 and is designated generally by reference numeral 28. The cover 28 includes an upper panel A and a lower panel B. The upper and lower panels A and B are of substantially the same configuration and, in general, conform in configuration to the general shape of the lid 20. Each of the upper and lower panels is made of a relatively soft flexible fabric material and, in a preferred embodiment of the invention, each of these panels is a pile fabric having fibers 30 which extend a substantial distance from an underlying backing or substrate 32. Each of the panels A and B also is characterized in having a continuously curving outer arcuate peripheral edge 34 and a straight back or hinged side edge 36. This configuration is typified by the panel A as it is illustrated in FIG. 1. It is important to note that the cover 28 and lid 20 illustrated in the drawings are mated in their dimensions such that the straight rear or hinge side edge 36 of the panels A and B is substantially equivalent in length to the straight back edge 22 of the lid 20. As will be subsequently understood, varying types of lids as now marketed may have a longer or shorter rear edge than the rear edge 22 of the lid 20 here under discussion, and the cover 28 of this invention is susceptible to use on these variant lids to provide an aesthetic covering appearance when installed.

With the panels A and B superimposed in the manner illustrated, the major portion of the arcuate peripheral edges 32 of each of the two panels are sewn together by stitching through underturned or reversed, abutting edge portion of each of the panels. This type of joindure of the two panels is illustrated at the left side of FIG. 4 where the stitching joining the two underturned portions of the panels is illustrated and is designated by reference numeral 38. It will be noted that stitching the arcuate peripheral edge portions of the two panels to each other in this manner causes the seam or hem thus formed to be hidden because of the manner in which the fibers 30 of the pile fabric used in each of the panels project out and hide the location of the seam or hem line.

The stitching 38 is extended around the arcuate peripheral edge portions of the two panels A and B for joining these panels together, with such stitching being projected around the outer side of the lid cover 28 and back towards the hinge 18 to a location on the cover 28 where it extends across the widest portion of the lid 20. This is at about the mid-portion of the cover 28 or, stated differently, approximately half the length of a line extending normal to the midpoint of the straight back edges 36 of the panels A and B and projected to the most forward location on the panels in relation to the hinge 18.

Figure 3:
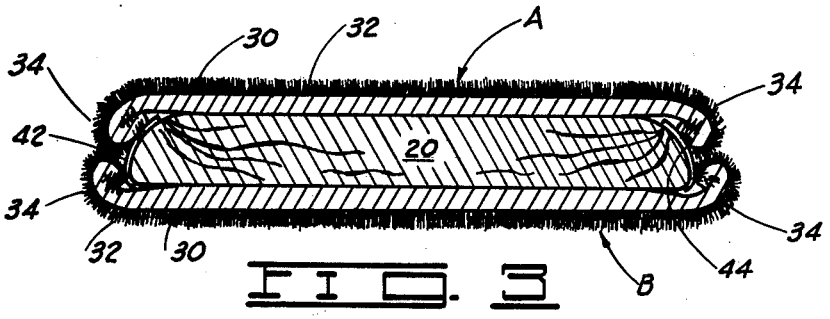
FIG. 3 is a sectional view taken along line 3—3 of FIG. 1.

The remaining portions of the arcuate peripheral edges 34 of the two panels A and B (this being the portions thereof which project from the ends of the stitching 38 to the opposite ends of the straight back edges 36) are joined to each other by elastomeric bands or strips 42 and 44. The elastomeric bands or strips 42 and 44 can be constructed of any suitable material which is resiliently stretchable in a direction transversely of the band or strip. Stated differently, the direction of stretch which is characteristic of the band or strip of elastomeric material will permit the panels A and B to be pulled farther apart from each other than they are shown in FIG. 3, with the bands 42 and 44 being thereby loaded in resilient deformation.

The back edges 36 of the panels A and B are spaced from each other and are not connected to each other. They thus define opposite sides of an opening formed at this side of the cover 28, and it is through this opening that the lid 20 is inserted at the time that the cover is installed thereon. The opposite ends of the opening between the rear edges 36 of the panels A and B are closed by the elastomeric bands 42 and 44. By reason of the resiliency hereinbefore described as characteristic of these bands, this opening can be enlarged as may be necessary to enable the cover 28 to be pushed over, and mounted on, the lid 20. It can thus be seen that the cover 28 as thus constructed can be aesthetically mounted on various types of water closet lids, and that the area on each of the panels A and B which is adjacent the back edge 36 thereof will remain smooth and undistorted when the cover is in position. This is because the panels A and B do not themselves undergo expansion or contraction as is required to mount the cover, and to adapt it to various sizes of lids, but rather this necessary variation in size is accommodated by the expansion and relaxation of the elastic bands 42 and 44. It should be pointed out that in a preferred construction of the invention, the elastomeric bands 42 and 44 will also undergo resilient deformation in a direction extending normal to the direction of expansion and contraction across the transverse width of these bands. This is to say that the second direction of resilient expansion and contraction is in a plane which is substantially coincident with the major plane of the lid 30. This capability aids the panels A and B of the cover 28 in being more aesthetically accommodated to lids of varying sizes.

From the foregoing description of a preferred embodiment of the invention, it will be perceived that the invention provides an improved and highly useful and aesthetic cover for water closet lids. Various changes and innovations in the described structure can be effected without departure from the basic principles which underlie the invention. Changes and innovations of this type are therefore deemed to be circumscribed by the spirit and scope of the invention, except as the same may be necessarily limited by the appended claims or reasonable equivalents thereof.

What is claimed is:

1. A cover for a water closet lid comprising:

an upper flexible fabric panel of generally oval configuration and having an outer arcuate peripheral edge and a straight back edge;

a lower flexible fabric panel of generally oval configuration and complimentary in configuration to the upper panel, said upper and lower flexible panels each having a widest portion as measured along a line extending parallel to said straight back edge thereof;

a first elastomeric band at the aligned ends of one of the ends of the straight back edges of said upper and lower panels joining a first portion of said outer arcuate peripheral edges of the upper and lower panels to each other;

a second elastomeric band at the aligned ends of the second of the ends of the straight back edges of said upper and lower panels joining a second portion of said outer arcuate peripheral edges of the upper and lower panels to each other, said first and second elastomeric bands each being elastically stretchable in a direction substantially normal to the straight edges of said upper and lower panels, and also in a direction substantially parallel to said straight back edges, and said first and second elastomeric bands each extending from the respective ends of said straight back edges to said widest portion of said upper and lower panels as measured along said line substantially parallel to said back edges; and means joining the remaining portions of the outer arcuate peripheral edges of the upper and lower panel to each other where said panels are not joined by said first and second elastomeric bands to form a closed cover open only at the space between the straight back edges thereof.

2. A cover for a water closet lid as defined in claim 1 wherein said joining means comprises stitching joining said remaining portions of said outer arcuate peripheral edges to each other while said edges are turned over through a reverse bend and abutted against each other.

3. A cover for a water closet lid as defined in claim 1 wherein each of said first and second elastomeric bands is elastically stretchable in a direction substantially normal to the straight back edges of said upper and lower panels, and also in a direction substantially parallel to said straight back edges.

4. A cover for a water closet lid as defined in claim 2 wherein each of said fabric panels is a pile fabric and the pile fibers thereof substantially hide said stitching.

5. A cover for a water closet lid as defined in claim 1 wherein said first and second elastomeric bands extend from the respective ends of said straight back edges to the widest portion of said upper and lower panels as measured along a line substantially parallel to said back edges.

6. In combination, an oval-shaped water closet lid having a straight back edge and a continuously curving arcuate edge defining a peripheral edge of the lid terminating at opposite ends of the straight back edge;

hinge means connected to the lid adjacent the straight back edge thereof; and a lid cover having an opening at one side thereof between opposed back edges and receiving said hinge means therethrough, said lid cover further including:

a first flexible pile fabric panel positioned on one side of said lid and extending tautly across said lid;

a second flexible pile fabric panel positioned on the opposite side of said lid from said first panel and stitched to said first panel at a location adjacent a major portion of said continuously curving arcuate edge; and stretchable elastic means interconnecting portions of said first and second panels to each other at locations between said stitching interconnecting said first and second panels and said opening at one side of said lid cover and facilitating resilient enlargement of said opening, said elastic means including a pair of elastic bands each resiliently stretchable in two planes extending normal to each other, said bands being located at opposite ends of said opening.

* * * * *